United States Patent [19]

Rittenbaum et al.

[11] 3,945,736

[45] Mar. 23, 1976

[54] EXTENSION MOP

[76] Inventors: Max Rittenbaum, 1886 River Forest Road NW., Atlanta, Ga. 30327; Jeffrey A. Rittenbaum, 5563 Woodbury Circle, Marietta, Ga. 30060

[22] Filed: Sept. 23, 1974

[21] Appl. No.: 508,272

[52] U.S. Cl. ..... 401/289; 15/229 BP; 15/229 AP

[51] Int. Cl. ..... A46b 11/06; A47l 13/22

[58] Field of Search ..... 401/289, 285, 203–205; 15/229 BP, 229 AP

[56] References Cited

UNITED STATES PATENTS

| | | | |
|---|---|---|---|
| 1,665,153 | 4/1928 | Withycombe | 401/289 |
| 1,834,510 | 12/1931 | Ygater | 401/289 X |
| 2,929,087 | 3/1960 | Salmon | 15/229 BP |
| 2,940,102 | 6/1960 | Marinus | 401/203 X |
| 3,063,084 | 11/1962 | Marinus | 401/203 |
| 3,196,475 | 7/1965 | Brown | 15/228 |

*Primary Examiner*—Lawrence Charles
*Attorney, Agent, or Firm*—Patrick F. Henry

[57] ABSTRACT

This mop comprises a removable cleaning cover or mitt which is folded about an open wire mop frame over which is mounted an absorbent pad of foam plastic and the like. A long extension handle optionally may be a water conduit having one end attached to a fitting mounted on the frame inside the foam pad and the other, remote end is provided with a plastic gripping handle and a water hose coupling. The mitt is a chenille-like fabric with an open pocket which is closed by a foldable flap. This device is especially useful for washing automobiles, windows and the like where extension is necessary.

2 Claims, 3 Drawing Figures

EXTENSION MOP

BACKGROUND OF THE INVENTION

1. Field of the Invention

Cleaning implements and the like and especially self-feeding mops especially those having extension means thereon.

2. Description of the Prior Art

The present commercial prior art usually extension, self-feeding mops on which are mounted mop heads ususally employing a plastic spray-like device which includes plastic brush filaments. Such devices perform a mediocre job of cleaning dirty surfaces such as automobiles, windows and the like. In addition, after a short period of use the brush filaments usually become bent and broken and the spray head loses its utility. Also, the water is sometimes released at a faster or more voluminous rate than desired. Such commercial devices do not perform as well as hand mitts which are dipped in solution and rubbed on the finish. However, hand mitts do not have any source of water and lack any extension means. The present device provides an extension mop which produces the cleaning effect of a hand mitt but at the same time optionally includes water supply and a means of distributing the water.

SUMMARY OF THE INVENTION

An object of this invention is to provide an extension mop which includes a removable mitt over a protected frame.

Another advantage of this invention is found in the combination of an extension handle which serves optionally as the liquid conduit and in addition a support frame that is covered and protected by an absorbent pad and a removable mitt.

Still another object of this invention resides in the particular construction of the extension handle, the absorbent pad and the mitt whereby fabrication and assembly is kept to a minimum cost to make the item economically feasible.

An additional object of this invention resides in the particular construction of the frame enclosed completely in an absorbent pad which is held in place by the fabric mitt.

Other and further objects and advantages of this invention will become apparent upon reading the following specification taken in conjunction with the accompanying drawings, in which:

DESCRIPTION OF THE PREFERRED EMBODIMENT

Figure 1:
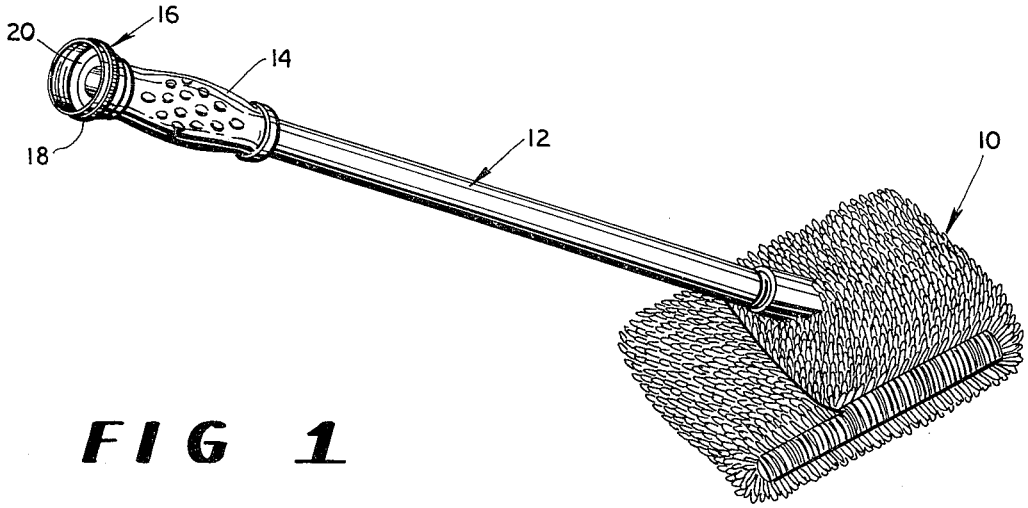
FIG. 1 is a perspective view of the assembled mop of this invention.

The complete device is designated in the drawings by reference numeral 10 and comprises an extension handle member 12 which in this embodiment may be in the form of a conduit tube made from plastic, aluminum or the like on which is mounted a plastic grip 14 which comprises a preshaped gripping sleeve of plastic material such as vinyl tightly fitted to the end of the extension tube 12. The handle 12 may be of solid wood or other material as the conduit construction is optional.

A coupling designated generally by reference numeral 16 comprises a fixed internally threaded coupling collar 18 of the general type found on common garden hoses and which is fitted with a common washer 20 of rubber or plastic and includes a rigid coupling insert plug member 22 tightly fitted into the end of the extension tube member 12. A garden hose (not shown) has the male fitting screwed into the internally threaded coupling collar 18.

Figure 3:
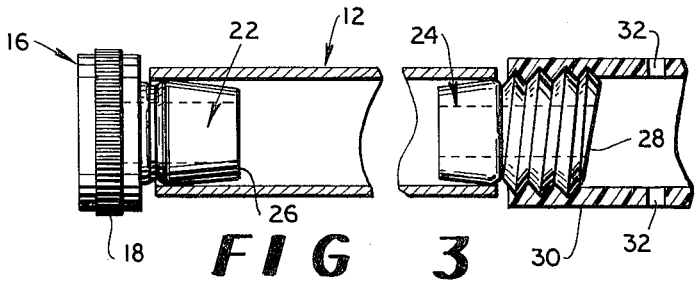
FIG. 3 is a cross-sectional view of the extension conduit of the invention shown in FIG. 1 with parts broken away.
Figure 2:
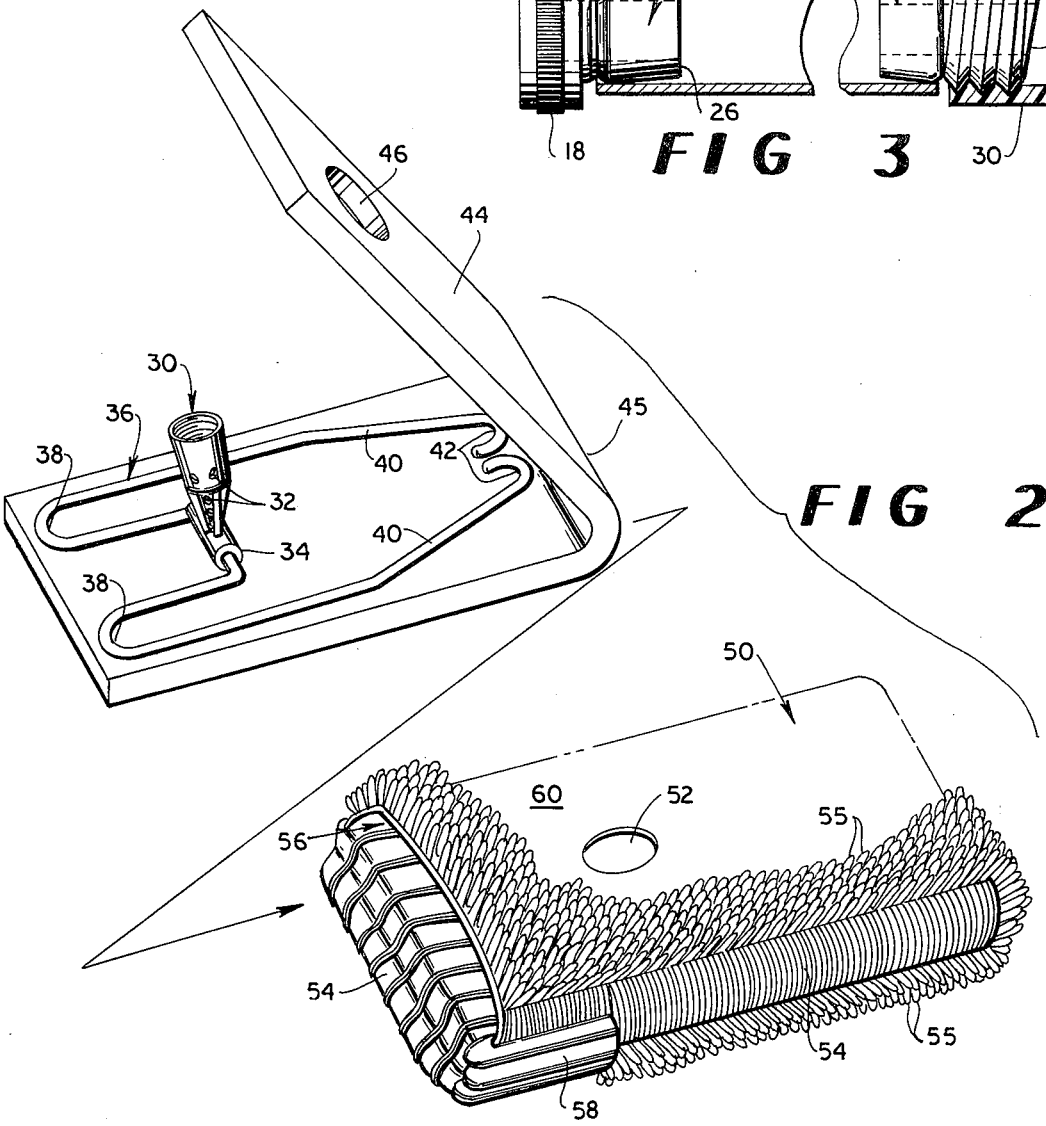
FIG. 2 is a disassembled assembly view of the mop shown in FIG. 1 with the extension handle omitted.

The lower end of the tube 12 remote from the coupling collar 18, as shown in FIGS. 1 and 3, comprises a threaded insert 24 which includes a cylindrical plug 26 tightly fitted into the end of the tube 12 and including a threaded end 28 screwed into the internally threaded body of the spray fitting 30, constructed from molded plastic and the like, which includes holes 32 from which the liquid pumped through the tube 12 emits. The lower part of the fitting 30 includes a sleeve 34 in which is mounted a portion of a wire frame 36 comprising generally in the same plane a pair of loops 38 each leading to a respective side wire member 40 which bends in the shape shown in FIG. 2 into terminal ends 42 thereby providing a support frame about which is mounted absorbent pad 44 which may be made from plastic foam, foam rubber or some other acceptable absorbent material. The foam pad 44 is generally in a rectangular formation bent upon itself about a marginal edge 45 to place a hole 46 over the spray fitting 30 which protrudes therethrough.

The cleaning mitt 50 is made from a fabric similar to a chenille material which comprises a substrate or backing material 54 which may be woven from natural or synthetic materials in which is tufted the pile of the material comprising a plurality of yarn filaments arranged in rows and generally referred to as pile fabric. The fabric backing material 54 of the mitt 50 is folded upon itself and stitched together to form a three-dimensional arrangement having an open mouth or entrance 56 which may be closed by a flap 58 that is folded back around the bottom of the mitt 50 to open the mouth 56 and then after the assembled frame 36 and foam pad 44 are inserted into the pocket in the mitt 50 to place the spray fitting 30 projecting through both of the openings 46 and 52, the flap 58 is folded back upon the top 60 of the mitt.

In the operation of the device 10 in which the handle 12 is a conduit water or other liquid fed under pressure through the tube 12 emits under pressure from the holes 32 and soaks the foam pad 44 as well as the mitt 50 but without producing a loose or uncontrolled spray. Thus, the mitt 50 is constantly being washed and cleaned and soaked in continuous conrinuous process by the liquid thereby to wash away the dirt and at the same time there is no forceful spray against the surface being cleaned. The frame 36 provides sufficient rigidity and support to enable the remote use of the mitt 50 holding it at the handle 14 and since the underside of the mitt 50 is well padded and completely protected there is no hardware or hard surfaces to scratch the surface being cleaned.

When in use without a water supply, or when the handle 12 is made solid, handle 12 is dipped in a bucket of water, water and soap or detergent, etc. and used on the surface being washed as an extension mop. Therefore, the handle 12 may be disconnected at any time from a water supply and the device 10 used as a mop.

While I have shown and described a particular embodiment of this invention together with suggested use thereof there is by way of illustration only and does not constitute any sort of limitation on the scope of the invention since various alterations, changes, eliminations, deviations, revisions and departures may be made from the embodiment shown without departing from the scope of the invention as defined only by proper interpretation of the appended claims.

I claim:

1. In an extension mop: an extension handle having a fitting attached to one end thereof, an open wire frame having said wire members substantially in the same plane and said side wire members having said fitting movably attached thereto near the middle of the frame, a resilient absorbent pad having substantially flat portions covering both the top and the bottom of said frame and said pad having a hole in the top portion through which projects said fitting and with the handle extending therefrom, a cleaning mitt constructed to form a three-dimensional arrangement having an open mouth and said mitt being made from a pile material comprising yarn filaments arranged in rows, said mitt mouth being closable by means of a foldable flap which is folded around the bottom to open the mouth and upon the top of the mitt around the resilient absorbent pad which is compressed therein to close the mouth and thereby completely cover the absorbent pad, said flap being attached on the sides of said mitt and folding around the edges and over the top of the mitt thereby securing the mitt in place with the pad compressed therein to hold said mitt in place, and said mitt having a hole therein just large enough to accommodate the handle at the fitting, whereby the mitt will not normally dislodge from the position covering the absorbent material even during heavy scrubbing and whereby the frame is prevented from contacting the surface being cleaned, and said resilient pad is compressed within said flap to provide a sufficiently tight fit to hold said mitt in place and prevent the mitt from becoming dislodged during cleaning.

2. The device in claim 1 wherein said handle is a hollow conduit for conducting water or other liquid and there are openings in said fitting inside said pad from which said liquid emits to soak said pad from inside without producing a loose spray on the outside.

* * * * *